US006120948A

United States Patent [19]

Ishihara

[11] Patent Number: 6,120,948

[45] Date of Patent: Sep. 19, 2000

[54] LASER ABLATIVE RECORDING MATERIAL

[75] Inventor: Makoto Ishihara, Kanagawa, Japan

[73] Assignee: Fuji Photo Film Co., Ltd., Kanagawa, Japan

[21] Appl. No.: 09/280,858

[22] Filed: Mar. 30, 1999

[30] Foreign Application Priority Data

Mar. 30, 1998 [JP] Japan ..... 10-083895

[51] Int. Cl.[7] ..... B41M 5/26

[52] U.S. Cl. ..... 430/14; 430/201; 430/270.1; 430/945; 503/227

[58] Field of Search ..... 430/200, 201, 430/945, 269, 270.1, 14; 503/227; 156/239

[56] References Cited

U.S. PATENT DOCUMENTS

| | | | |
|---|---|---|---|
| 4,973,572 | 11/1990 | DeBoer | 430/200 |
| 5,190,849 | 3/1993 | Santoh et al. | 430/945 |
| 5,360,694 | 11/1994 | Thien et al. | 430/201 |
| 5,401,618 | 3/1995 | Chapman et al. | 430/945 |
| 5,429,909 | 7/1995 | Kaszcuk et al. | 430/201 |
| 5,529,884 | 6/1996 | Tutt et al. | 430/945 |
| 5,695,907 | 12/1997 | Chang et al. | 430/201 |
| 5,725,993 | 3/1998 | Bringley et al. | 430/200 |

FOREIGN PATENT DOCUMENTS

| | | | |
|---|---|---|---|
| 0698503 | 8/1995 | European Pat. Off. | 430/200 |
| 7-041501 | 2/1995 | Japan | 430/200 |
| 10-086513 | 4/1998 | Japan | 430/200 |
| 10-236001 | 9/1998 | Japan | 430/200 |

*Primary Examiner*—John A. McPherson
*Attorney, Agent, or Firm*—Sughrue, Mion, Zinn, Macpeak & Seas, PLLC

[57] ABSTRACT

A laser ablative recording material having on a support at least one coloring agent layer and at least one overcoat layer, where the overcoat layer contains an infrared-absorbing material exhibiting absorption in the laser wavelength region. By using the laser ablative recording material, an image will be obtained with a high sensitivity and high resolution.

16 Claims, No Drawings

LASER ABLATIVE RECORDING MATERIAL

BACKGROUND OF THE INVENTION

1. Field of the Invention

The present invention relates to a laser ablative recording material, and in particular to a laser ablative recording material in which its over coat layer contains infrared-absorbing material having absorption in the laser wavelength region to achieve an improved sensitivity. The present invention also relates to a recorded matter containing an image formed with the laser ablative recording material.

2. Related Art

Recently, a thermal transfer system forming an image by imparting an electric signal to a thermal print head has become more popular. A method of forming an image by the use of a laser in place of the thermal print head was on the other hand developed, and is expected to become more popular along with the tendency toward a higher laser output.

A recording material for laser recording contains a material having a strong absorption in the laser wavelength region, and this absorbing material converts optical energy into thermal energy, and brings about effects similar to those available by the use of a thermal print head. Use of a laser, unlike the use of a thermal print head, permits heating without contact with a recording material, thus providing an advantage of the image surface free from flaws. Because of the possibility to stop down a laser beam, there is provided another advantage of improving image resolution.

A method for forming an image using a high-output laser known as the dye ablation has recently been developed. Japanese Unexamined Patent Publications Nos. 7-164,755, 7-149,063, and 7-149,065 (corresponding to U.S. Pat. No. 5,330,876, U.S. Pat. No. 5,401,618 and U.S. Pat. No. 5,459,017) disclose recording materials applicable in this method, and Japanese Unexamined Patent Publications Nos. 8-48,053 and 8-72,400 (corresponding to U.S. Pat. No. 5,521,629 and U.S. Pat. No. 5,574,493) disclose imaging apparatuses used in this method. Image recording based on the ablation method is accomplished by irradiating a laser from a dye layer side onto a recording material having a dye layer comprising an image dye, a material having absorption in the laser wavelength region (infrared-absorbing material) and a binder formed on a support. On the spot to which the laser beam has been irradiated, a sharp local change takes place in an image forming layer under the effect of energy from the laser, and this drives away the material from the layer. According to the aforesaid patent publications, this local change is not a perfectly physical change such as melting, evaporation or sublimation, but a kind of chemical change such as bond-breaking, and is believed to be a complete, not partial, removal of the image dye.

Usefulness of this dye ablation imaging method largely depends upon removal efficiency of the imaging dyes upon laser exposure. As a scale representing this efficiency, the minimum density value (Dmin) of the laser exposure portion is employed, where a smaller value of Dmin corresponds to a higher dye removing efficiency.

Thus has been proposed several methods for lowering Dmin to achieve improved sensitivity of the recording material. Japanese Unexamined Patent Publication No.7-149063, for example, describes use of a cyanine dye, having a specific zwitter ion, as a material which exhibits an intense absorption in the laser wavelength region. Japanese Unexamined Patent Publication No. 7-164755 specifies molecular weight of a binder as contained in a coloring agent layer. Japanese Unexamined Patent Publication Nos. 7-149065 and 8-52948 describe an intermediate layer (barrier layer) made of hydrophilic or hydrophobic polymer binder and interposed by coating between a support and a coloring agent layer. Japanese Unexamined Patent Publication No. 7-149066 discloses that Dmin can be improved by incorporating an infrared-absorbing material into the intermediate layer.

It has however been still difficult to obtain high sensitivity,high resolution and fully satisfactory image despite all improving efforts in photo-thermal conversion material (infrared-absorbing material), binder resin, image forming material and so forth.

It is therefore an object of this invention to solve the above problems. That is, it is an object of this invention to provide a laser ablative recording material capable of yielding image with a high sensitivity and high resolution. In other words, it is an object of this invention to provide a laser ablative recording material capable of achieving Dmin lower than that for any known ablative recording material without impairing the resolution. It is also an object of this invention to provide a recorded matter with a high resolution obtained by laser ablation.

SUMMARY OF THE INVENTION

The present inventors have found after thorough investigation to address the above problems that incorporation of some infrared-absorbing material having absorption in the laser wavelength region into the overcoat layer resulted in Dmin lowered in a large extent, which led us to provide the present invention.

That is, the present invention is to provide a laser ablative recording material characterized in that having on a support at least one coloring agent layer and at least one over coat layer, and the overcoat layer contains an infrared-absorbing material having absorption in the laser wavelength region.

In a preferred embodiment of this invention, carbon black and/or titanium black or pigment represented by the following general formula (1) are used as coloring agent(s) for the coloring agent layer.

$$M_xA_yQ_z \quad (1)$$

In the general formula (1), M is at least one metal atom, A is at least one alkaline metal, Q is at least one oxygen atom or sulfur atom, x is an integer of 1–3, y is an integer of 0–2and z is an integer of 1–4.

The overcoat layer preferably contains polytetrafluoroethylene bead.

In a preferred embodiment of this invention, an intermediate layer is formed between the support and the coloring agent layer. The intermediate layer preferably contains an infrared-absorbing material exhibiting absorption at laser wavelength, and nitric esters of carboxyalkyl cellulose having a degree of nitric ester group substitution per anhydrous glucose of 0.2 or above, and a degree of carboxyalkyl ether group substitution of 0.05 or above.

In a still other preferred embodiment of this invention, the back coat layer may be formed on the surface of the support on the opposite side to the coloring agent layer. The outermost layer surface of the back coat layer should preferably have a Beck smoothness of up to 4,000 seconds.

This invention also provides a laser ablative recorded matter having a formed image obtained by irradiating the above laser ablative recording material with laser light.

DETAILED DESCRIPTION OF THE INVENTION PREFERRED EMBODIMENTS

The following paragraphs will illustrate in detail the laser ablative recording material and the laser ablative recorded matter containing a formed image.

A laser ablative recording material of this invention is characterized in that having on a support at least one coloring agent layer and at least one over coat layer, and the overcoat layer contains an infrared-absorbing material exhibiting absorption in the laser wavelength region.

The amount of coating of the infrared-absorbing material in the overcoat layer is so selected to make absorbance in the laser wavelength region fall within a range from 0.1 to 1.0 inclusive, and more preferably from 0.3 to 0.6 inclusive. Absorbance below 0.1 will cause no decrease in Dmin probably because the photo-thermal conversion efficiency scarcely changes. On the other hand, absorbance beyond 1.0 will cause increase in Dmin probably because energy transmission towards the coloring agent layer becomes insufficient due to excess absorption of laser beam energy by the overcoat layer.

Infrared-absorbing material to be contained in the overcoat layer is not limited as far as it exhibits absorption within a laser wavelength to be employed. Applicable infrared-absorbing materials include, for example, carbon black, cyanic infrared-absorbing dye disclosed in U.S. Pat. No. 4,973,572, and materials disclosed in U.S. Pat. Nos. 4,948,777, 4,950,640, 4,950,639, 4,948,776, 4,948,778, 4,942,141, 4,952,552, 5,036,040, 4,912,083, 5,360,694, 5,380,635 and JPA No. 8-189,817.

Typical examples of infrared-absorbing material suitably applicable for the laser ablative recording material of the invention are presented below. Infrared-absorbing materials applicable for the laser ablative recording material of the invention are not however limited to those enumerated below.

(1)

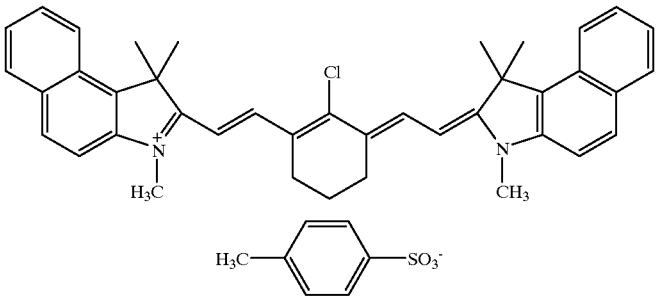

(2)

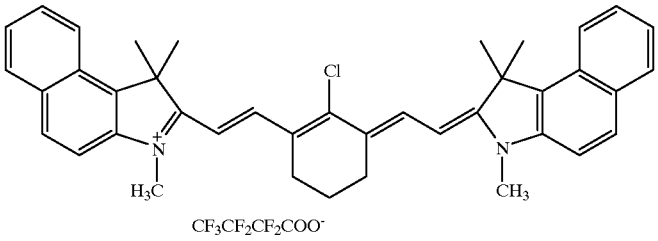

(3)

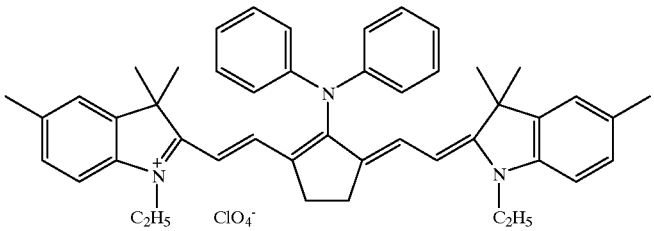

-continued
(4)
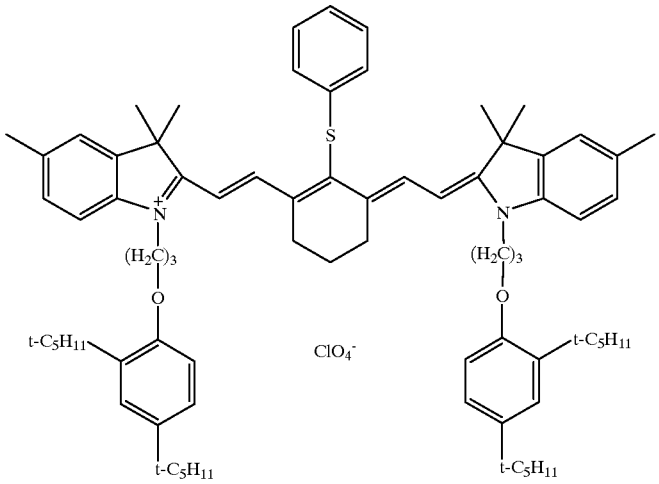
(5)
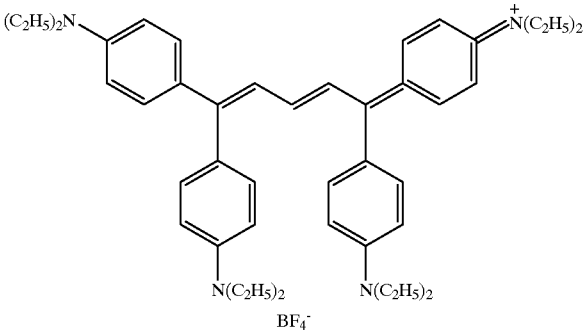
(6)
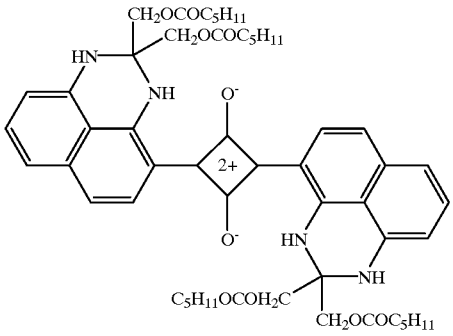
(7)
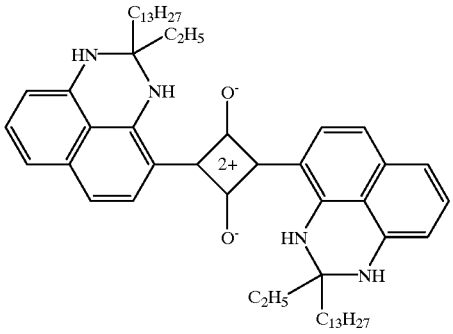

-continued (8)

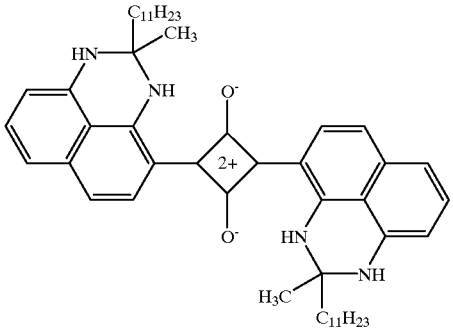

These infrared-absorbing materials may be included into a layer other than the overcoat layer. Inclusion into the coloring agent layer, or inclusion into the intermediate layer interposed between the support and the coloring agent layer is allowable. When included into a layer other than the overcoat layer, the amount of coating of the infrared-absorbing material is so selected to have absorbance in the laser wavelength of 0.5 or above, more preferably 1.0 or above, and still more preferably 1.5 or above.

In the recording material of this invention, an overcoat layer may be provided for the purpose of imparting satisfactory scraping resistance, wear resistance and mat finish, as is disclosed in Japanese Unexamined Patent Publication No. 8-108,622. Provision of the overcoat layer permits easy handling because of the slightest risk of discoloration of the formed image caused by finger prints or the like.

Beads may be contained in the overcoat layer. Particularly, polytetrafluoroethylene beads should preferably be contained in terms of lowering Dmin. The particle size and the coating amount of polytetrafluoroethylene beads can be set within a range effective for achieving the intended object. In general, the particle size should preferably be within a range of from about 0.1 to about 20 $\mu$m, or more preferably, from about 0.1 to about 5 $\mu$m. The coating amount should be within a range of from about 0.005 to about 5.0 g/m$^2$, or more preferably, within a range of from about 0.05 to about 0.5 g/m$^2$. Polytetrafluoroethylene beads are not necessarily required to be in a spherical shape, but may be in any arbitrary shape.

As the binder of the overcoat layer containing beads, any arbitrary polymer may be used. More specifically, applicable polymers include cellulose derivatives such as cellulose nitrate, cellulose acetate hydrogen phthalate, cellulose acetate, cellulose acetate propionate, cellulose acetate butylate, cellulose triacetate, hydroxypropyl cellulose ether, ethyl cellulose ether, polycarbonate; polyurethane, polyester; poly(vinyl acetate); poly (vinyl halide) such as poly (vinyl chloride) and poly(vinyl chloride) copolymers; poly (vinyl ether); maleic acid anhydride copolymer; polystyrene; poly(styrene-co-acrylonitrile); polysulfon; poly (phenylene oxide); poly(ethylene oxide); poly(vinylalcohol-co-acetal) such as poly(vinyl acetal), poly(vinylacetal-co-butyral) and poly(vinylbenzal); and mixtures and copolymers thereof. The binder for the overcoat layer can be used in a coating amount within a range of from about 0.1 to about 5 g/m$^{2.}$ At least one coloring agent layer is provided in the recording material of the invention. A pigment, an inorganic particulate or a dye is preferably used as a coloring agent in the coloring agent layer.

Preferable pigments and inorganic particulates include carbon black, graphite, titanium black, metal phthalocyanine, metal oxides such as titanium oxide, pigments represented by the following general formula (1) and colloidal silver.

$$M_xA_yQ_z \quad (1)$$

In the general formula (1), M is at least one metal atom, A is at least one alkaline metal, Q is at least one oxygen atom or sulfur atom, x is an integer of 1–3, y is an integer of 0–2 and z is an integer of 1–4. Preferable are the compounds where M is copper atom or iron atom, A is potassium atom, sodium atom or lithium atom, Q is oxygen atom.

Preferable pigments which can be used in the recording material of the present invention are represented by the general formula (1) where M is copper atom or iron atom, A is potassium atom, sodium atom or lithium atom, Q is oxygen atom. Examples of the preferable pigments include CuO, CuS, $Cu_2S$, NiO, NiS, AgO, $Ag_2O$, AgS, SnO, $Fe_3O_4$, $CuFe_2O_4$, $NaCuO_2$, $LiMn_2O_4$, $LiCuO_2$, $La_2CuO_4$, $MoS_2$, $TaS_2$, $Co_3O_4$ and $MnS_2$.

When using the recording material for manufacturing a printing plate, the pigment or the inorganic particulate used is required to have absorption in the UV region. When it is used for medical purposes, the pigment or the inorganic particulate used should be black in color. The particle size which gives a color of the pigment or the inorganic particulate, which largely varies with circumstances, should preferably be within a range of from 5 to 500 nm, or more preferably, from 5 to 250 nm.

The amount of coated pigment or inorganic particulate should be within a range in which the laser non-irradiated portion has absorption of a concentration of over 2.5 (absorption value in the UV region for printing and IC printed board fabrication purposes, and absorption value in the visible region for medical purposes). In general, the coating amount varies with the kind or size of inorganic particulate used. For example, when coating carbon black (particle size: 24 nm) in a coating amount of 0.67 g/m$^2$, there are obtained a UV concentration of 4.0 and a visible concentration of 2.7. Titanium black (primary particle size: 58 nm) in a coating amount of 0.74 g/m$^2$, leads to a UV concentration of 4.0 and a visible concentration of 3.6.

Use of a pigment or an inorganic particulate having absorption in the laser wavelength region is preferable because of the simultaneous availability of two functions including a laser wavelength absorbing material and a coloring agent. More specifically, this is favorable in that the necessity of individually preparing a laser wavelength absorbing material and a coloring agent is eliminated or alleviated.

There is no particular limitation imposed on the method of manufacturing a pigment or an inorganic particulate used in the invention so far as manufacture of the foregoing particle size is permitted. For example, the channel method, the thermal method and the furnace method disclosed in Donnel Voet, "Carbon Black" Marcel Dekker, Inc. (1976) are applicable for a carbon black material.

A dye of any kind may be used for the coloring agent layer of the invention so far as it permits ablation by laser irradiation. For example, dyes disclosed in Japanese Unexamined Patent Publications Nos. 7-149,065, 7-149,066 and 8-104,065; and U.S. Pat. Nos. 4,541,830, 4,698,651, 4,695,287, 4,701,439, 4,757,046, 4,743,582,4,769,360, and 4,753,922 can by appropriately applied. These dyes may be used either alone or in combination. The amount of coating of these dyes is preferably set so that the concentration in the laser non-irradiated portion (absorption value in the UV region for printing and IC printed board fabrication purposes, and absorption value in the visible region for medical purposes) will have an absorption of 2.5 or above, and is generally set within a range of from about 0.05 to about 1 $g/m^2$.

As far as at least one coloring agent layer and at least one overcoat layer are formed on the support, there is no specific limitation imposed on the composition of any other layers included in the laser ablative recording material of this invention. Thus allowable cases include two or more coloring agent layers or overcoat layers, an intermediate layer interposed between the support and the coloring agent layer, and an undercoat layer interposed between the intermediate layer and the support for improved adhesiveness. Also a back coat layer may be formed on the surface of the support on the opposite side to the coloring agent layer.

One preferable layer composition of the laser ablative recording material relates to such that the intermediate layer, the coloring agent layer and the overcoat layer are formed on the support in this order. The intermediate layer formed here preferably contains the above-described infrared-absorbing material exhibiting absorption at the laser wavelength. It is also preferable to use, as a binder, nitric esters of carboxyalkyl cellulose having a degree of nitric ester group substitution per unhydrous glucose unit of 0.2 or above, and a degree of carboxyalkyl ether group substitution of 0.05 or above. Use of such intermediate layer will successfully lower Dmin in the laser irradiated area and increase the ablation efficiency.

Wide variety of binders may be used in the coloring agent layer side of the recording material of the invention provided that the components of the layers are dispersed in the binders. Preferable binders are decomposable polymers which are quickly pyrolized by heat generated from laser irradiation and gives a gas in a sufficient quantity and a volatile fragment, or a decomposable polymer of which the decomposition temperature considerably decreases in the present of a slight amount of an acid. Preferable ones of such decomposable polymer include those having a polystyrene equivalent molecular weight of over 100,000 as measured by size-excluded chromatography disclosed in U.S. Pat. No. 5,330,876 (F. W. Billmeyer, "Textbook of Polymer Science", 2nd ed., 53–57).

Particularly preferable binders for the coloring agent layer side of the recording material of the invention are nitric esters of carboxyalkyl cellulose and cellulose nitrate. Nitric esters of carboxyalkyl cellulose are prepared by reacting a carboxy alkylcellulose such as carboxymethyl cellulose and carboxyethyl cellulose with a mixed acid for nitric esterification comprising for example sulfuric acid, nitric acid and water to achieve a degree of nitric ester group substitution in the carboxyalyl cellulose of at least 0.2 and a degree of carboxyalkyl ether group substitution of at least 0.05. Examples of the nitric esters of carboxyalkyl cellulose include the aqueous cellulose derivatives disclosed in Japanese Unexamined Patent Publications Nos.5-39301 and 5-39302 which are hereby incorporated herein by reference.

Any layers on the coloring agent layer side provided in the laser ablative recording material of this invention may preferably contain nitric esters of carboxyalkyl cellulose. The nitric esters of carboxyalkyl cellulose may be contained in the coloring agent layer, or in the intermediate layer interposed between the support and the coloring agent layer, or in the overcoat layer formed on the coloring agent layer.

The nitric esters of carboxyalkyl cellulose used in the invention preferably have a degree of nitric ester group substitution within the range of from 0.2 to 2.2 and a degree of carboxyalkyl ether group substitution within the range of from 0.05 to 1.5. Adegreeof nitric ester group substitution of under 0.2 is not desirable because of insufficient dispersibility and water resistance of a developer and a dye. A degree of carboxyalkyl ether group substitution of under 0.05 leads to an insufficient solubility in water, as to practical impossibility to use the same as a water-soluble binder.

A degree of nitric ester group substitution of over 2.2 is not desirable because of the necessity of increasing the consumption of an organic solvent to dissolve or disperse the same in a mixed solvent of water and an organic solvent. A degree of carboxyalkyl ether group substitution of over 1.5 tends to a slightly insufficient water resistance of the coated surface. Carboxyl group of nitric ester of carboxyalkyl cellulose used in the invention may be partially or totally neutralized. Neutralization increases solubility into water and a water-soluble soluble organic solvent mainly comprising water. For the purpose of neutralizing the carboxyl group, one or more of an alkali metal ion, an alkali earth metal ion, ammonium ion and a cation of an organic amine or the like may be used. The extent of neutralization, depending upon the chemical composition of the target solution including water and organic solvent contents, should preferably be in general such that 50% or more of carboxyl group are neutralized.

Any layers on the coloring agent layer side provided in the laser ablative recording material of the invention may preferably contain a nitric esters of carboxyalkyl cellulose. The nitric esters of carboxyalkyl cellulose may be contained in the coloring agent layer, or in the intermediate layer present between the support and the coloring agent layer, or in the overcoat layer present on the coloring agent layer.

The amount of coated nitric ester of carboxyalkyl cellulose should preferably be within a range of from 0.05 to 5 $g/m^2$, or more preferably, of from 0.1 to 3 $g/m^2$.

In the recording material of the invention, a nitric ester of carboxyalkyl cellulose may be used either alone or in combination with at least one of known binders.

Examples of the known binders include cellulose derivatives such as carboxymethyl cellulose and hydroxyethyl cellulose, and polymers such as polyvinyl alcohol, carboxydenatured polyvinyl alcohol, polyvinyl pyrrolidone, polyacrylic acid, polyacrylamide and gelatin, but are not limited to those enumerated above. Latex-based binders such as styrenebutadiene latex and urethane latex may also be used.

A back coat layer may be provided in the laser ablative recording material of the invention. The back coat layer may be formed on the surface of the support on the opposite side to the coloring agent layer.

From the point of view of adhesivity and strippability between recording materials, the outermost layer surface of the back coat layer should preferably have a Beck smoothness of up to 4,000 seconds, or more preferably, within a range of from 10 to 4,000 seconds. Beck smoothness can be easily determined in accordance with the Japanese Industrial Standard (JIS) P8119 "Smoothness Testing Method of Paper and Cardboard by Beck Tester" and the TAPPI Standard Method T479.

Beck smoothness can be controlled by adjusting the average particle size and the quantity of addition of a matting agent to be contained in the overcoat layer of the back coat layer. In the invention, the matting agent should preferably have an average particle size of up to 20 $\mu$m, or more preferably, within a range of from 0.4 to 10 $\mu$m. The quantity of added matting agent should preferably be within a range of from 5 to 400 mg/m$^2$, or more preferably, from 10 to 200 mg/m$^2$.

As the matting agent used in the invention, any solid particles may be used so far as they do not cause a problem in handling, and may be either inorganic or organic. Examples of inorganic matting agent include silicon dioxide, titanium and aluminum oxides, zinc and calcium carbonates, barium and calcium sulfates, and calcium and aluminum silicates. Applicable organic matting agents include organic polymers such as cellulose esters, polymethylmethacrylate, polystyrene and polydivinylbenzene and copolymers thereof.

In the invention, it is desirable to use a porous matting agent disclosed in Japanese Unexamined Patent Publication No. 3-109,542, page 2, left lower column, line 8 through page 3, right upper column, line 4, an alkali surface-modifying matting agent disclosed in Japanese Unexamined Patent Publication No.4-127,142, page 3, right upper column, line 7 through page 5, right lower column, line 4, or an organic polymer matting agent disclosed in Japanese Patent Application No. 6-118,542 paragraph Nos. [0005] to [0026].

These matting agents may be used either alone or two or more thereof in combination. Manners of simultaneous use of two or more matting agents include simultaneous use of an inorganic matting agent and an organic matting agent, simultaneous use of a porous matting agent and a non-porous matting agent, simultaneous use of an amorphous matting agent and a spherical matting agent, and simultaneous use of matting agents with different average particle sizes (for example, simultaneous use of a matting agent having an average particle size of at least 1.5 $\mu$m disclosed in Japanese Patent Application No. 6-118,542 and a matting agent having an average particle size of up to 1 $\mu$m).

A conductive layer having a surface resistance of up to $10^{12}\Omega$ at 25 °C. and 30% RH may be provided in the recording material of the invention. The conductive layer may be provided either on the coloring agent layer side of the support or on the back coat layer side. A single conductive layer or two or more such layers may be provided. Further, the conductive layer may be prepared by adding a conductive material to a layer having other functions such as a surface protecting layer, a back coat layer or a primer layer.

The conductive layer can be formed by coating a coating solution containing a conductive metal oxide or a conductive polymeric compound.

As a conductive metal oxide, it is desirable to use crystalline metal oxide particles. Among others, a particularly preferable one is a conductive metal oxide containing an oxygen defect or containing exotic atom in a slight amount, which forms a donor to the metal oxide used, which has in general a high conductivity. Applicable metal oxides include ZnO, $TiO_2$, $SnO_2$, $Al_2O_3$, $In_2O_3$, $SiO_2$, MgO, BaO, $MoO_3$ and $V_2O_5$ and composite oxides thereof. Particularly, ZnO, $TiO_2$ and $SnO_2$ are preferable. Effective examples containing an exotic atom include ZnO containing added Al, In or the like, $SnO_2$ containing added Sb, Nb or a halogen element, and $TiO_2$ containing added Nb, Ta or the like. The quantity of addition of the exotic atom in these cases should preferably be within a range of from 0.01 to 30 mol %, or more preferably, from 0.1 to 10 mol %.

The metal oxide particulate used in the invention should preferably be conductive and have a volume resistivity of up to $10^7$ Ω.cm, or more preferably, up to $10^5$ Ω.cm. These oxides are disclosed in Japanese Unexamined Patent Publications Nos. 56-143,431, 56-120,519 and 58-62,647.

A conductive material prepared by causing the aforesaid metal oxides to adhere to other crystalline metal oxide particles or a fibrous material (titanium oxide, for example) may also be used, as is disclosed in Japanese Examined Patent Publication No. 59-6,235.

The conductive material used in the invention should preferably have a particle size of up to 10 $\mu$m, or more preferably, up to 2 $\mu$m with a view to ensuring stability after dispersion. In order to achieve the lowest possible light scattering, it is desirable to use conductive particles having a particles size of up to 0.5 $\mu$m. Use of such conductive particles permits maintenance of transparency of the support by providing a conductive layer.

When the conductive material is acicular-shaped or fibrous, the material should preferably have a length of up to 30 $\mu$m and a diameter of up to 2 $\mu$m, or more preferably, a length of up to 25 $\mu$m and a diameter of up to 0.5 $\mu$m, with a length/diameter ratio of at least 3.

Preferable conductive polymeric compounds applicable in the invention include polyvinylbenzenesulfonic salts, polyvinylbenziltrimethylammonium chloride, grade-4 polymers as disclosed in U.S. Pat. Nos. 4,108,802, 4,118,231, 4,126,467, and 4,137,217, and polymer latexes as disclosed in U.S. Pat. No. 4,070,189, West German Unexamined Patent Publication No. 2,830,767, Japanese Unexamined Patent Publications Nos. 61-296,352 and 61-62,033.

Some concrete examples of the conductive polymeric compound of the invention are enumerated below. Conductive materials applicable in the invention are not however limited to those presented below. The composition of the following polymers is of the invention are enumerated below. Conductive materials applicable in the invention are not however limited to those presented below. The composition of the following polymers is expressed in percentage of polymerization.

(1)

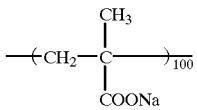

(2)

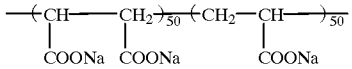

-continued (3)

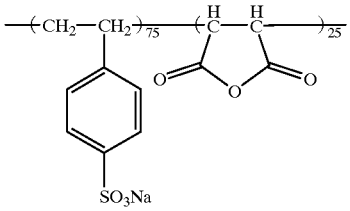

(4)

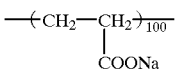

(5)

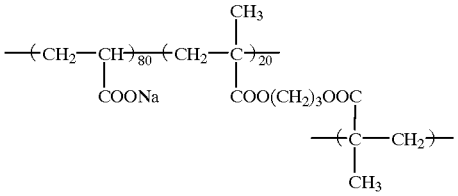

(6)

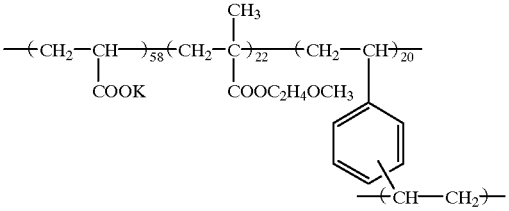

(7)

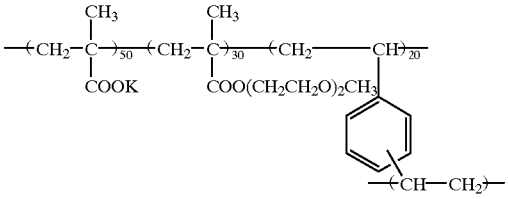

The conductive metal oxide or the conductive polymeric compound is used for forming a conductive layer after dispersing or dissolving in a binder.

The binder used for dispersing or dissolving the conductive metal oxide or the conductive polymeric compound is not particularly limited so far as a film-forming ability is available. For example, applicable binders include protein such as gelatin and casein, cellulose compounds such as carboxymethyl cellulose, hydroxyethyl cellulose, acetyl cellulose, diacetyl cellulose, and triacetyl cellulose, dextran, agar, soda alginate, saccharides such as starch derivatives, and synthetic polymers such as polyvinyl alcohol, polyvinyl acetate, polyacrylic ester, polymethacrylic ester, polystyrene, polyacrylamide, poly-N-vinylpyrrolidone, polyester, polyvinyl chloride, and polyacrylic acid.

Particularly preferable ones include gelatin (lime-treated gelatin, acid-treated gelatin, enzyme-decomposed gelatin, phthalized gelatin, acetylated gelatin, etc.), acetyl cellulose, diacetyl cellulose, triacetyl cellulose, polyvinyl acetate, polyvinyl alcohol, polyacrylic butyl, polyacrylamide, and dextran.

In order to effectively reduce resistance of the conductive layer, a higher volume content of the conductive metal oxide or the conductive polymeric compound is more preferable. However, a binder content of under 5% leads to a lower strength of the conductive layer, and is therefore undesirable. The volume content of the conductive metal oxide or the conductive polymeric compound should therefore preferably be set within a range of from 5 to 95%.

The consumption of the conductive metal oxide or the conductive polymeric compound per $m^2$ of the recording material of the invention should preferably be within a range of from 0.05 to 20 $g/m^2$, or more preferably, from 0.1 to 10 $g/m^2$. To impart a satisfactory antistatic property, the surface resistivity of the conductive layer should be up to $10^{12}\Omega$ under conditions including 25 ° C. and 30% RH, or more preferably, up to $10^{11}\Omega$.

A better antistatic property can be imparted by simultaneously using a fluorine-containing surfactant in addition to the foregoing conductive material. As the fluorine-containing surfactant used in the conductive layer, a surfactant may have a fluoroalkyl group, an alkenyl group or an aryl group having a carbon number of at least 4, and as an ionic group, an anion group (sulfonic acid (salt), sulfuric acid (salt), carboxylic acid (salt), phosphoric acid (salt)) a cation group (amine salt, ammonium salt, aromatic amine salt, sulfonium salt, phosphonium salt), betaine group (carboxyamine salt, carboxyammonium salt, sulfoamine salt, sulfoammonium salt, phosphoammonium salt) or a nonion group (substituted, non-substituted polyoxyalkylene group, polyglyceril group or sorbitan residue). These fluorine-containing surfactants are disclosed in Japanese Unexamined Patent Publication No.49-10,722, British Patent No. 1,330,356, U.S. Pat. Nos. 4,335,201, 4,347,308, B.P. No. 1,417,915, Japanese Unexamined Patent Publication No. 55-149,938, 58-196,544, and B.P. No. 1,439,402. 55-149,938, 58-196,544, and B.P. No. 1,439,402.

Examples of the fluorine-containing surfactant applicable in the conductive layer are enumerated below.

(1)

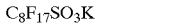

(2)

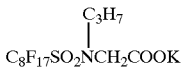

(3)

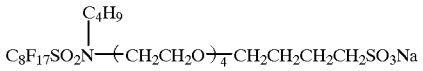

(4)

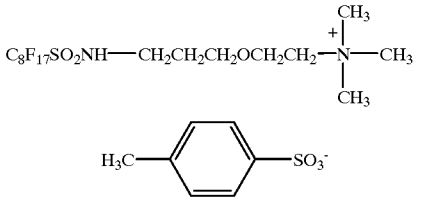

(5)

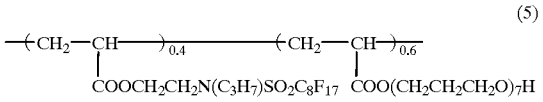

As the support in the recording material of the invention, any material may be used so far as it has a size stability and can withstand heat produced by laser irradiation. Materials applicable as a support include polyesters such as poly (ethylene naphthalate) and poly (ethylene terephthalate); polyamide; polycarbonate; cellulose esters such as cellulose acetate; fluoro-polymers such as poly(vinylidene fluoride) and such as polyoxymethylene; polyacetal; polyolefins such as plystyrene, polyethylene, polypropylene and methylpentenpolymer; polyimides such as polyimide and polyetherimide; and syndiotactic polystyrene. The thickness of the support, not particularly limited, should usually be within a range of from about 5 to about 200 μm.

The support is subjected to surface treatment to add adhesiveness. Possible surface treatments include chemical treatment, mechanical roughening treatment, corona discharge treatment, flame treatment, UV treatment, radio-frequency treatment, glow discharge treatment, active plasma treatment, laser treatment, mixed acid treatment, and ozone oxidation treatment. It is preferable through these treatments to make the surface of the support have a contact angle with water of 65° C. or below, and more preferably 55° C. or below, since such angles will ensure good adhesiveness with a layer coated on the support.

An image can be recorded on the recording material of the invention in accordance with an ordinary laser ablation recording method.

In the present invention, laser irradiation is preferably accomplished from the coloring agent layer side since image forming based on the single sheet method is possible without the necessity of a receiving material.

The ablative recording material of the invention should have a Dmin of up to 0.11 after laser irradiation, as is described in Japanese Unexamined Patent Publication No. 8-48,053. With a Dmin of up to 0.11, a luster line recognizable by naked eyes is largely eliminated. In order to achieve a Dmin of up to 0.11, the laser beam intensity for writing produced by the laser diode onto the recording material should preferably be at least 0.1 $mW/\mu m^2$.

In order to form a laser ablative image on the recording material of the invention, it is desirable to use an infrared diode laser having light emission at above 700 nm. Such a diode laser has practical advantages in that it is compact in size, low in cost, has high stability and reliability, is robust and permits easy modulation.

Laser ablation recording onto the recording material of the invention can be conducted with the use of a commercially available laser irradiating apparatus. Applicable such apparatuses include the laser model SDL-2420-H2 of Spectra Diode Labs., and the laser model SLD304 V/W of Sony Corporation.

When a laser is irradiated onto the recording material of the invention, the material is partially ablated from the support and is scattered into the surrounding open air. The ablated material may gather around the laser apparatus, or accumulate on the portion written with laser. This dump shuts off the laser beam, causes Dmin to increase over the allowable level, and may thus make the image quality degraded to become impracticable. To cope with such a problem, it is desirable to simultaneously use an apparatus for removing the ablated material with an air flow. An example of such a removing apparatus is disclosed in Japanese Unexamined Patent Publication No. 8-72,400.

A laser ablative record with an image formed by laser irradiation onto the recording material of the invention should preferably be subjected to a treatment for increasing durability of the image. For example, a protecting layer may be formed on the surface of the coloring agent layer side for the protection of the image.

The protecting layer may be formed by the use of an image protecting laminated sheet disclosed in Japanese Unexamined Patent Publication Nos. 5-504,008 and 6-344,676. This image protecting laminated sheet has a support and a substantially transparent and wear-resistant withstanding layer (protecting layer), and the support and the withstanding layer are bonded together by a weak bonding layer formed therebetween. In application, the withstanding layer of the image protecting laminated sheet is first placed face to face with the image of the recording material, and after bonding of the surfaces of the withstanding layer and the recording material, the support of the image protecting laminated sheet is stripped off. By doing so, a withstanding layer is formed on the surface of the recording material and plays a role of a protecting layer. Particularly, when adopting the protecting layer forming method disclosed in Japanese Unexamined Patent Publication No. 6-344,676, the protecting layer never peels off even by repeatedly using a strong adhesive tape upon printing or repeatedly washing the image.

A typical example of the material for the protecting layer used in the invention is a polymeric organic material containing siloxane as disclosed in Japanese Unexamined Patent Publication No. 6-344,676. A siloxane-containing polymeric material can be prepared, for example, through co-polymerization of an organic monomer or oligomer functionalized with a vinylether group and a siloxane monomer or oligomer. One prepared by any other method is also applicable. The protecting layer on the image has usually a thickness of up to 30 μm, and in order to prevent an excessive decrease in resolution, the thickness should preferably be up to 10 μm, or more preferably, within a range of from 0.5 to 6 μm.

The laser ablative record having an image formed by irradiating a laser onto the recording material of the invention may be stored or used directly for record, or used as a printing plate for printing purposes or as a film for printing. The areas of application thereof widely cover diverse and various fields including press printing, printing for facsimile output, various commercial prints, and medical images. Either a positive or a negative image may be selected and formed on the recording material of the invention in response to the purpose of use, A person skilled in the art could appropriately select a support of the recording material and a material for the coloring agent for the recording material of the invention, depending upon a particular object of application.

EXAMPLES

Now, the present invention will be described further in detail by means of examples. The chemical compositions, the ratios and the procedures shown in the following examples may be appropriately modified within the scope not deviating from the spirit of the present invention. The scope of the present invention is not therefore limited by the following examples.

Binder liquid A used in this invention is referred as to a 10% solution of nitric ester of carboxymethyl cellulose having a degree of nitric ester group substitution per anhydrous glucose unit of 2.1 and a degree of carboxymethyl ether group substitution of 0.7 (the residual part is acetone 40%, methanol 20% and water 30%, adjusted at pH6.9 with aqueous ammonia).

Surface Treatment on Support

Both surfaces of a polyethylene terephthalate film having a thickness of 100 μm were processed with a glow discharge. The process conditions was set at 0.2 Torr process atmosphere pressure, 40% water partial pressure in the atmospheric gas, 30 kHz discharge frequency, 2500 W output, and 0.5 $kV.A.min/m^2$.

Formation of First Back Coat Layer (Conductive Layer)

A hydrated stannic chloride 230 weight parts and an antimony trichloride 23 weight parts were dissolved in 3,000 weight part ethanol to prepare a uniform solution. To this solution, IN sodium hydroxide aqueous solution was dropped to adjust the pH to 3, thereby forming a co-precipitate of colloidal stannic oxide and antimony oxide. The resultant co-precipitate was held at 50° C. for 24 hours and a red-brown colloidal precipitate was obtained. The red-brown colloidal precipitate was then separated by a centrifugal separation method, and excess ions were removed by rinsing manipulations repeated three times in which water was added for centrifugal separation.

Subsequently, 200 weight part colloidal precipitate from which excess ions were removed was dispersed again in 1,500 weight part water. The resultant dispersion solution was sprayed onto a baking oven heated to 500° C., thereby obtaining bluish micro powder of stannic oxide-antimony oxide composite mixture. The micro powder had an average particle size of 0.005 $\mu$m and a resistivity of 25 Ω.cm. A mixed solution of 40 weight part obtained fine powder and 60 weight part water was adjusted to pH 7.0, and roughly dispersed by means of a stirrer. Then, the solution was dispersed in a horizontal type sand mill (Dynomill, made by Willy A. Backfen AG.) to achieve a retention time of 30 minutes, thus preparing a dispersed solution in which primary particles partially aggregated as a secondary aggregate (its average particle size is 0.05 $\mu$m).

A coating liquid for forming a first back coat layer having the following composition was prepared using the dispersed liquid of conductive fine particles thus obtained. The coating liquid for forming the first back coat layer was coated on the surface of the support and dried at 110° C. for 30 seconds to obtain a first back coat layer having a dried film thickness of 0.3 $\mu$m.

TABLE 1

| Components | Weight part |
|---|---|
| Dispersed solution of conductive particles ($SnO_2/Sb_2O_3$:0.05 $\mu$m) | 100 |
| Calcified gelatin ($Ca^{2+}$ content:100 ppm) | 10 |
| Water | 270 |
| Methanol | 600 |
| Resorcin | 20 |
| Poly-oxyethylene nonyl phenyl ether | 0.1 |

Formation of Second Back Coat Layer

A coating liquid for forming a second back coat layer having the following composition was coated on the first back coat layer and was dried at 110° C. to obtain a second back coat layer having a dried film thickness of 1.2 $\mu$m.

TABLE 2

| Components | Weight part |
|---|---|
| Diacetyl cellulose | 100 |
| Trimethylolpropane-3-toluenediisocyanate | 25 |
| Metyl ethyl ketone | 1050 |
| Cyclohexanone | 1050 |
| Crosslinked polymer matting agent (copolymer of methyl methacrylate: divinylbenzene = 9:1) (mean particle size 3.5 $\mu$m) | 2 |

Formation of Third Back Coat Layer

The following components of Liquid A were mixed and solved by raising their temperature at 90° C. The obtained liquid was added to Liquid B having the following composition. The mixture was dispersed by a high pressure homogenizer, thereby creating a coating liquid for forming a third backcoat layer. The coating liquid for forming a third back coat layer was coated on the second back coat layer so that the coating amount becomes 10 ml/m$^2$.

TABLE 3

| Components | Weight part |
|---|---|
| (Liquid A) | |
| Lubricant: $C_6H_{13}CH(OH)(CH_2)_{10}COOC_{40}H_{61}$ | 0.7 |
| Lubricant: n-$C_{17}H_{35}COOC_{40}H_{81-n}$ | 1.1 |
| Xylene | 2.5 |
| (Liquid B) | |
| Propyleneglycol monomethyl ether | 34.0 |
| Diacetyl cellulose | 3.0 |
| Acetone | 600.0 |
| Cyclohexanone | 350.0 |

Formation of Backcoat Layer

A coating liquid for forming a back coat layer having the following composition was coated on the third back coat layer so that the amount of coating of diacetyl cellulose equals 1.14 g/m$^2$ and then dried to obtain the back coat layer.

TABLE 4

| Components | Weight part |
|---|---|
| Diacetyl cellulose | 100.0 |
| Trimethylolpropane-3-toluenediisocyanate | 10.0 |
| Copolymer of methyl methacrylate: divinylbenzene = 9:1 (crosslinked polymer matting agent, mean particle size 8.0 $\mu$m) | 0.9 |
| Fluoren TG710 (35%:product of Kyoeisha Kagaku Co., Ltd.) | 10.0 |
| Metyl ethyl ketone | 1230.0 |
| Cyclohexanone | 1230.0 |

Beck smoothness of the outermost surface of the obtained back coat layer was 400 seconds. All formation by coating on the side of the back coat layer were thus completed. Formation by coating of the intermediate layer, coloring agent layer and overcoat layer was then carried out according to the procedures explained below.

Formation of Intermediate Layer

Any one of the coating liquids, having compositions listed below, for forming the intermediate layer was coated on the surface of the support opposite to the back coat layer. The liquid was coated so as to adjust the amount of coating of polyvinyl butyral to 0.3 g/m$^2$ for the intermediate layers 1 and 2, and so as to adjust the amount of coating of carboxymethyl cellulose nitrate to 0.3 g/m$^2$ for the intermediate layers 3 and 4.

TABLE 5

| Intermediate layer | Components | Weight part |
|---|---|---|
| 1 | Polyvinyl butyral (Butbar B76:product of Monsant Co., Ltd.) | 0.3 |
| 2 | Polyvinyl butyral (Butbar B76:product of Monsant Co., Ltd.) | 0.3 |
| | Infrared-absorbing material (1) | 0.1 |
| 3 | Binder liquid A | 17.0 |
| | Acetone | 11.8 |
| | Methanol | 12.1 |
| | Water | 9.2 |
| 4 | Binder liquid A | 17.0 |
| | Acetone | 11.8 |

TABLE 5-continued

| Intermediate layer | Components | Weight part |
|---|---|---|
| | Methanol | 12.1 |
| | Water | 9.2 |
| | Infrared-absorbing material (1) | 0.57 |

Formation of Coloring Agent Layer

Any one of the coating liquids for forming the coloring agent layer, obtained by, using a paint shaker, homogeneously dispersing each mixture having compositions listed below, was coated on the intermediate layer. The liquid was coated so as to adjust the amount of coating of carbon black to 0.67 g/m$^2$ for coloring agent layer 1, and so as to adjust the amount of coating of titaniuum black to 0.74 g/m$^2$ for the coloring agent layer 2. The liquid was coated so as to adjust the amount of coating of cupric oxide to 0.77 g/m$^2$ for coloring agent layer 3.

TABLE 6

| Coloring agent layer | Components | Weight part |
|---|---|---|
| 1 | Cellulose nitrate (RS 1/8 sec:product of Daicel Chemical Industries, Ltd.) | 5 |
| | Isopropyl alcohol | 2.14 |
| | Methyl isobutyl ketone | 26.6 |
| | Methyl ethyl ketone | 82.0 |
| | Solsparse S20000 (product of Zeneca K.K.) | 1.35 |
| | Disperbyk-161 (product of BYK Chemie Co., Ltd.) | 2.0 |
| | Carbon black (particle size 23 nm, oil absorption 66 ml/100 g) | 5 |
| | Fluorine-containing surfactant (5) | 0.0373 |
| 2 | Cellulose nitrate (RS 1/8 sec:product of Daicel Chemical Industries, Ltd.) | 5 |
| | Isopropyl alcohol | 2.14 |
| | Methyl isobutyl ketone | 26.6 |
| | Methyl ethyl ketone | 82.0 |
| | Solsparse S20000 (product of Zeneca K.K.) | 1.35 |
| | Disperbyk-161 (product of BYK Chemie Co., Ltd.) | 2.0 |
| | Titanium black (particle size 58 nm, product of Mitsubishi Materials) | 5 |
| | Fluorine-containing surfactant (5) | 0.0338 |
| 3 | Cellulose nitrate (RS 1/8 sec:product of Daicel Chemical Industries, Ltd.) | 5 |
| | Isopropyl alcohol | 2.14 |
| | Methyl isobutyl ketone | 26.6 |
| | Methyl ethyl ketone | 82.0 |
| | Solsparse S20000 (product of Zeneca K.K.) | 1.35 |
| | Disperbyk-161 (product of BYK Chemie Co., Ltd.) | 2.0 |
| | Cupric oxide (product of Wako Pure Chemical Industries, Ltd) | 5 |
| | Fluorine-containing surfactant (5) | 0.0373 |

Formation of Overcoat Layer

Any one of the coating liquids for forming the overcoat layer, having compositions listed below, was coated on the coloring agent layer. The liquid was coated so as to adjust the amount of coating of polyethyl methacrylate to 0.12 g/m$^2$.

TABLE 7

| Over coat layer | Components | Weight part |
|---|---|---|
| 1 | Polyethyl methacrylate | 0.42 |
| | Cyclohexanone | 4.57 |
| | Methanol | 3.97 |
| | Isopropyl alcohol | 20.04 |
| | Diacetone alcohol | 7.03 |
| | Infrared-absorbing material (1) | 0.21 |
| 2 | Polyethyl methacrylate | 0.42 |
| | Polytetrafluoroethylene bead (Zonyl TLP-10F-1:product of Du Pont Co., Ltd.:particle size 0.2 μm) | 0.42 |
| | Fluoren TG710 (35%:Kyoeisha Kagaku Co., Ltd.) | 0.24 |
| | Cyclohexanone | 4.57 |
| | Methanol | 3.52 |
| | Isopropyl alcohol | 20.04 |
| | diacetone alcohol | 7.03 |
| 3 | Polyethyl methacrylate | 0.42 |
| | Polytetrafluoroethylene bead (Zonyl TLP-10F-1:product of Du Pont Co., Ltd.:particle size 0.2 μm) | 0.42 |
| | Fluoren TG710 (35%:Kyoeisha Kagaku Co., Ltd.) | 0.24 |
| | Cyclohexanone | 4.57 |
| | Methanol | 3.52 |
| | Isopropyl alcohol | 20.04 |
| | diacetone alcohol | 7.03 |
| | Infrared-absorbing material (1) | 0.21 |

Combinations of the intermediate layer, coloring agent layer and overcoat layer for individual recording materials were shown in Tables 8 to 10.

Exposure Conditions for Image Recording

Each Recording Material was set and fixed, with its coloring agent layer oriented outward, on a drum of the image exposure apparatus similar as that set forth in Japanese Unexamined Patent Publication (KOKAI) No. Heisei 8-48,053. A laser beam was irradiated under conditions of the laser beam wavelength range of 830 to 840 nm, the official output of 550 mW on the film surface, and the spot size of 25 μm. The exposure was controlled by changing the speed of the drum. For lateral movement, a laser diode mounted on a movable stage was moved with a speed rendering a distance between beam centers of 10 μm.

Using an apparatus similar to that as described in Japanese Unexamined Patent Publication (KOKAI) No. Heisei 8-72,400, laser was irradiated under air blow, which enabled efficient removal of image forming material or binder from the laser irradiated surface.

Measurement of Dmax and Dmin in the UV region

Using a densitometer (TD904, product of Macbeth Co.) equipped with a UV filter, densities of laser unirradiated area and irradiated area were measured to obtain Dmax (maximum density) and Dmin(minimum density) in the UV region, respectively. The results are shown in Table 8.

TABLE 8

| Recording Material No. | Intermediate layer No. | Coloring agent layer No. | Overcoat layer No. | Dmax | Dmin |
|---|---|---|---|---|---|
| 1 | 4 | 1 | 1 | 4.0 | 0.06 |
| 2 | 4 | 1 | 3 | 4.0 | 0.06 |
| 3 | 4 | 2 | 3 | 3.9 | 0.06 |
| 4 | 4 | 3 | 3 | 3.8 | 0.06 |

The above results indicate that recording materials 1 to 4 of this invention are low in Dmin and excellent for practical use. Recording materials 2 to 4 containing tetrafluoroethylene beads in the overcoat layer were found to have a matting effect larger than that for recording material 1 containing no tetrafluoroethylene beads in the overcoat layer, so that fingerprint occurred on the image was less recognizable and image showed a better readability.

Experiment 1

In this Experiment, Dmin was compared between recording materials having or not having an infrared-absorbing material in overcoat layers.

According to the method described in the Embodiment, 6 pairs total 12 types of laser ablation materials were prepared. combinations of the intermediate layer, coloring agent layer and overcoat layer for individual recording materials were as those listed in the table below, and a recording material containing an infrared-absorbing material in the overcoat layer and a recording material not containing such material were paired, to obtain total 6 pairs. Dmin of each recording material was measured according to the method described in the above Embodiment. Difference of Dmin for each pair was calculated, results of which being shown in the table below.

TABLE 9

| Intermediate layer No. | Coloring agent layer No. | Overcoat layer No. (with infrared-absorbing material) | ΔDmin |
|---|---|---|---|
| None | 1 | 2 (no) → 3 (yes) | −0.03 |
| 2 | 1 | 2 (no) → 3 (yes) | −0.04 |
| 3 | 1 | 2 (no) → 3 (yes) | −0.11 |
| 4 | 1 | 2 (no) → 3 (yes) | −0.02 |
| 4 | 2 | 2 (no) → 3 (yes) | −0.03 |
| 4 | 3 | 2 (no) → 3 (yes) | −0.02 |

The above results indicate that incorporation of an infrared-absorbing material into the overcoat layer will successfully lower Dmin.

Experiment 2

In this Experiment, Dmin was compared between recording materials containing or not containing infrared-absorbing material in their intermediate layers.

According to the method described in the Embodiment, 4 pairs total 8 types of laser ablation materials were prepared. Combinations of the intermediate layer, coloring agent layer and overcoat layer for individual recording materials were as those listed in the table below. Dmin of each recording material was measured according to the method described in the above Embodiment. Difference of Dmin for each pair was calculated, results of which being shown in the table below.

TABLE 10

| Intermediate layer No. (with infrared-absorbing material) | Coloring agent layer No. | Overcoat layer No. | ΔDmin |
|---|---|---|---|
| None → 1 (no) | 1 | 3 | −0.04 |
| 1 (no) → 2 (yes) | 1 | 3 | −0.09 |
| 3 (no) → 4 (yes) | 1 | 3 | −0.09 |
| 3 (no) → 4 (yes) | 1 | 1 | −0.06 |

Results in the above table indicate that provision of the intermediate layer will successfully reduce Dmin. It is also indicated that incorporation of infrared-absorbing materials into the intermediate layer will further reduce Dmin.

It is thus concluded that the laser ablative recording material of this invention containing an infrared-absorbing material in the overcoat layer is low in Dmin and highly practical. By using the laser ablative recording material, an image will be obtained with a high sensitivity and high resolution.

What is claimed is:

1. A laser ablative recording material having on a support at least one coloring agent layer and at least one overcoat layer, in which said coloring agent layer contains inorganic particulate as a coloring agent and said overcoat layer containing an infrared-absorbing material exhibits absorption in the laser wavelength region.

2. The laser ablative recording material according to claim 1, wherein said infrared-absorbing material is carbon black or cyanine infrared-absorbing dye.

3. The laser ablative recording material according to claim 1, wherein said infrared-absorbing material is a compound having any one of the following structures:

(1)

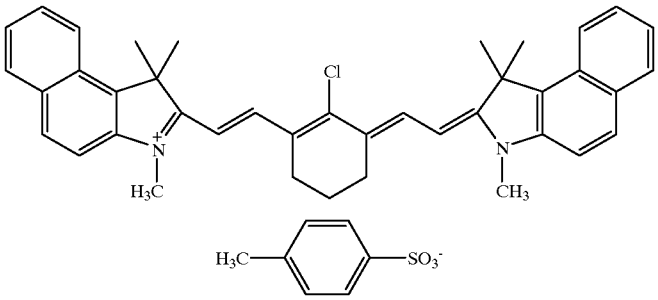

(2)

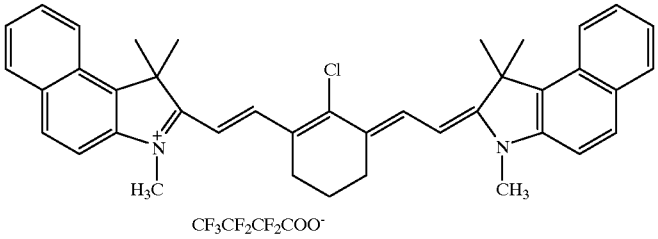

-continued
(3)
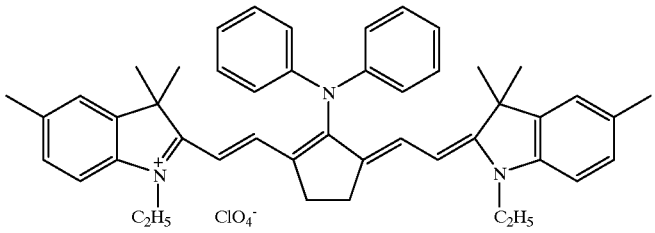
(4)
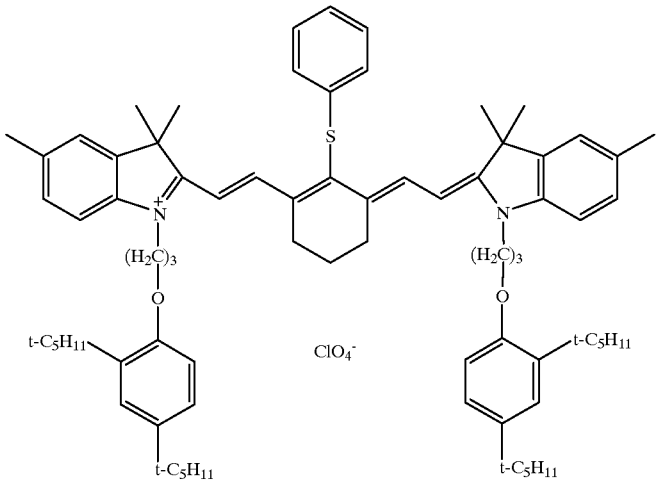
(5)
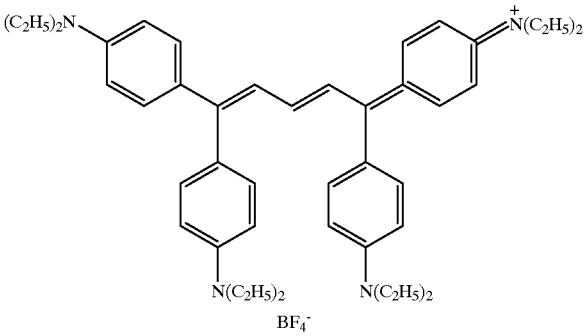
(6)
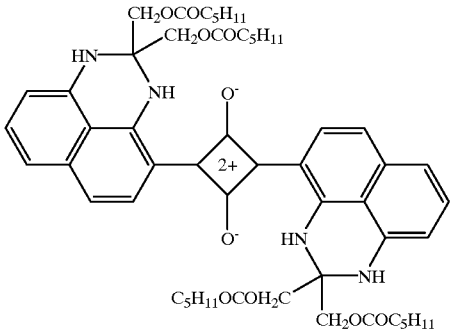

-continued (7)

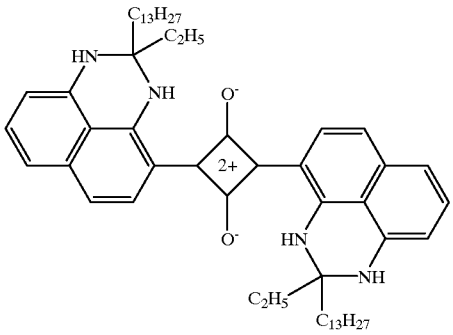

(8)

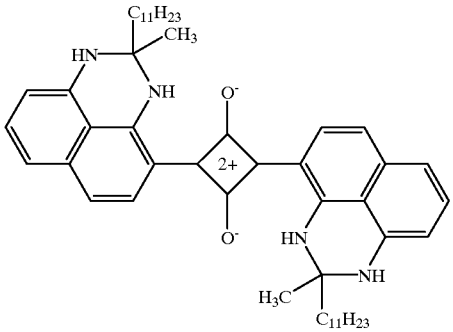

4. The laser ablative recording material according to claim 1, wherein content of said infrared-absorbing material in said overcoat layer is so selected to make absorbance fall within a range from 0.1 to 1.0 inclusive in the laser wavelength region.

5. The laser ablative recording material according to claim 1, wherein said overcoat layer contains polytetraflouroethylene beads.

6. The laser ablative recording material according to claim 5, wherein particle size of said bead is within a range from 0.1 to 5 $\mu$m.

7. The laser ablative recording material according to claim 5, wherein content of said bead in said overcoat layer is within a range from 0.05 to 0.5 g/m$^2$.

8. The laser ablative recording material according to claim 1, wherein said inorganic particulate is carbon black or titanium black.

9. The laser ablative recording material according to claim 1, wherein said infrared-absorbing material is contained also in the layer other than said overcoat layer.

10. The laser ablative recording material according to claim 1, wherein an intermediate layer is provided between said support and said coloring agent layer.

11. The laser ablative recording material according to claim 10, wherein said infrared-absorbing material is contained also in said intermediate layer.

12. The laser ablative recording material according to claim 10, wherein said intermediate layer contains nitric esters of carboxyalkyl cellulose having a degree of nitric ester group substitution per anhydrous glucose unit of 0.2 or above, and a degree of carboxyalkyl ether group substitution of 0.05 or above.

13. The laser ablative recording material according to claim 1, wherein a backcoat layer is provided on said support opposite to said coloring agent layer.

14. The laser ablative recording material according to claim 13, wherein Beck smoothness of the outermost surface of said backcoat layer is not larger than 4000 seconds.

15. A laser ablative recorded matter with a formed image obtained by irradiating the laser ablative recording material according to claim 1 with laser light.

16. The laser ablative recorded matter with a formed image according to claim 15, having a protecting layer provided on the surface of the coloring agent layer side after laser irradiation.

* * * * *